US010468215B2

(12) United States Patent
Lenoir et al.

(10) Patent No.: US 10,468,215 B2
(45) Date of Patent: Nov. 5, 2019

(54) TIMEPIECE COMPRISING A DEVICE FOR SWITCHING A TIMEPIECE MECHANISM

(71) Applicant: Montres Breguet S.A., L'Abbaye (CH)

(72) Inventors: Deirdre Lenoir, Le Sentier (CH); Davide Sarchi, Zurich (CH); Benoit Legeret, Ecublens (CH); Stephane Beugin, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 95 days.

(21) Appl. No.: 15/812,264

(22) Filed: Nov. 14, 2017

(65) Prior Publication Data

US 2018/0151317 A1 May 31, 2018

(30) Foreign Application Priority Data

Nov. 29, 2016 (EP) ..... 16201163

(51) Int. Cl.
*H01H 36/00* (2006.01)
*G04B 11/00* (2006.01)
(Continued)

(52) U.S. Cl.
CPC ..... *H01H 36/0073* (2013.01); *G04B 1/225* (2013.01); *G04B 3/048* (2013.01);
(Continued)

(58) Field of Classification Search
CPC ..... G04B 11/005; G04B 1/225; G04B 3/04; G04B 3/048; G04C 3/004; G04C 5/00;
(Continued)

(56) References Cited

U.S. PATENT DOCUMENTS 3,745,759 A * 7/1973 Kurosawa ..... G04C 3/061 368/161
4,409,576 A 10/1983 Petersen
(Continued)

FOREIGN PATENT DOCUMENTS

EP 2 897 003 A2 7/2015

OTHER PUBLICATIONS

European Search Report dated Jun. 16, 2017 in European application 16201163.9, filed on Nov. 29, 2016 (with English Translation of Categories Cited Documents).

*Primary Examiner* — Sean P Kayes
*Assistant Examiner* — Jason M Collins
(74) *Attorney, Agent, or Firm* — Oblon, McClelland, Maier & Neustadt, L.L.P.

(57) ABSTRACT

The timepiece includes a chronograph mechanism with a coupling device including an operating member and a switching member which can be switched alternately between two stable positions coupled state and uncoupled state. This timepiece includes a magnetic system formed of a first bipolar magnet fixed to the switching member, a second bipolar magnet fixed to the support of the switching device in order to continually offer a magnetic interaction with the first bipolar magnet, and at least one highly magnetically permeable element forming the operating member and able to undergo a reciprocating motion between two operating positions. The switching device is arranged so that, when the highly magnetically permeable element is in its first operating position, the two magnets generate between them a force of magnetic repulsion and so that, when the highly magnetically permeable element is in its second operating position, the two magnets generate between them a force of magnetic attraction.

13 Claims, 7 Drawing Sheets

(51) Int. Cl.

| | |
|---|---|
| ***G04B 1/22*** | (2006.01) |
| ***G04C 5/00*** | (2006.01) |
| ***G04F 7/08*** | (2006.01) |
| ***G04B 3/04*** | (2006.01) |

(52) U.S. Cl.
CPC ..... *G04B 11/005* (2013.01); *G04C 5/005* (2013.01); *G04F 7/0852* (2013.01); *G04F 7/0861* (2013.01)

(58) Field of Classification Search
CPC ..... G04C 5/005; G04F 7/08; G04F 7/0828; G04F 7/0861; H01H 36/00; H01H 36/0073
See application file for complete search history.

(56) References Cited

U.S. PATENT DOCUMENTS

| | | | | |
|---|---|---|---|---|
| 7,015,782 | B2 * | 3/2006 | Kincaid | F04B 9/02 335/205 |
| 9,921,546 | B2 * | 3/2018 | Legeret | G04B 13/026 |
| 10,037,010 | B2 * | 7/2018 | Legeret | G04F 7/0814 |

* cited by examiner

TIMEPIECE COMPRISING A DEVICE FOR SWITCHING A TIMEPIECE MECHANISM

This application claims priority from European Patent Application No. 16201163.9 filed on Nov. 29, 2016; the entire disclosure of which is incorporated herein by reference.

FIELD OF THE INVENTION

The present invention concerns a device for switching a timepiece mechanism between two operational states.

Generally, the present invention concerns a timepiece comprising a mechanism able to switch between a first state and a second state, a device for switching this mechanism and a device for actuating this switching mechanism. The switching device comprises an operating member actuated by the actuation device and a switching member capable of changing on demand from a first stable position, in which the mechanism is in its first state, to a second stable position, in which the mechanism is in its second state, and vice versa.

More particularly, the invention concerns a coupling device for a mechanism of a mechanical timepiece movement.

BACKGROUND OF THE INVENTION

Various devices for coupling a chronograph mechanism are known to those skilled in the art. EP Patent Application 2897003 discloses a conventional coupling device for a chronograph mechanism. This coupling device includes an intermediate wheel which, when the coupling is engaged (device in the coupled state), simultaneously meshes with a chronograph wheel and a drive wheel and which, when the coupling is disengaged (device in the uncoupled state), is removed from at least one of these two wheels to break the kinematic chain between them. To this end, the coupling device includes a coupling lever which carries the intermediate wheel at the end of one of its two arms and which is associated with a first return spring so that the end of the second arm of the coupling lever remains resting against a column wheel. The column wheel thus forms a kind of cam and the aforementioned end of the coupling lever forms a cam follower. To actuate the column wheel which alternately controls the coupling and uncoupling of the chronograph mechanism, there is provided a large lever which at one carries end a pivoted click associated with a second return spring.

The conventional coupling mechanism described above is complex. It comprises several pivoted members including a column wheel, which is a complex and therefore relatively expensive component. The two aforementioned springs generate friction forces in the mechanical contact areas provided, which results in wear. Moreover, such springs are fragile and their elasticity may vary with age. Finally, the various members must be precisely assembled in the timepiece in order to be functional, particularly the click actuating the column wheel and the large lever which generates the back-and-forth motion of the click.

SUMMARY OF THE INVENTION

It is an object of the present invention to propose a switching device for a timepiece mechanism of a different type from the aforementioned conventional type and which eliminates several drawbacks of such a conventional device.

To this end, the present invention concerns a timepiece comprising a mechanism capable of switching between a first state and a second state, a device for switching this mechanism between its first and second states and a device for actuating this switching device. The switching device comprises an operating member actuated by the actuation device and a switching member which can change on demand from a first stable position, in which the mechanism is in its first state, to a second stable position, in which the mechanism is in its second state and vice versa. This timepiece includes:

- a first bipolar magnet which is fixed to the switching member so as to undergo, when the switching member changes from its first stable position to its second stable position, a motion along a switching path between a first switching position and a second switching position, and vice versa,
- a second bipolar magnet which is fixed to the support of the switching device so as to continually offer a magnetic interaction with the first bipolar magnet between its first and second switching positions,
- at least a first highly magnetically permeable element at least partially forming the operating member.

The operating member is arranged so that, when it is repeatedly actuated by the actuation device, the first highly magnetically permeable element undergoes a back-and-forth motion (reciprocating motion) between a first operating position and a second operating position. The switching device is arranged so that, when the first highly magnetically permeable element is in its first operating position, the first and second magnets generate between them a magnetic repelling force over substantially the entire switching path and so that, when the first highly magnetically permeable element is in its second operating position, the first and second magnets generate between them a magnetic attraction force on at least one part of the switching path, this part being located on the side of the second bipolar magnet.

In a specific embodiment, which will not be described hereinafter, a spring having a relatively low return force is provided in addition to the magnetic switching device to participate in the movement of the switching member in one direction and/or to assist in holding this switching member in one of its stable positions. In particular, when the switching path is relatively long, such a spring can act on the switching member in order, when the first highly magnetically permeable element is in its second operating position, to move the switching member across a first part of the switching path located on the opposite side to the second bipolar magnet, until the magnetic attraction force intervenes to attract the switching member towards the second bipolar magnet.

In a preferred embodiment, the force of magnetic repulsion has an intensity and a range that are sufficient for the force of magnetic repulsion alone to actuate the switching member between its first stable position and its second stable position and then to hold said member in the second stable position; whereas the force of magnetic attraction has an intensity and a range that are sufficient for the force of magnetic attraction alone to actuate the switching member between its second stable position and its first stable position and then hold said member in this first stable position.

As a result of the magnetic system of the invention and particularly the operating member which includes at least one highly magnetically permeable element movable between the two aforementioned operating positions, the magnetic switching device defines a bistable system. Further, in the aforementioned preferred embodiment, the switching device does not require any return springs associated with the switching member.

In a preferred variant embodiment, the operating member is formed by a pivoted lever so that the highly magnetically permeable element undergoes a rotational motion between two determined angular positions when the operating lever is actuated. Such a lever constitutes a simpler component to make than a column wheel. In particular, the operating lever is pivoted so that the first highly magnetically permeable element undergoes a rotation between a first angular position and a second angular position respectively defining the first operating position and the second operating position. Next, when the first highly magnetically permeable element is in its second angular position, this first element is substantially located on an axis of alignment defined by the magnetic axis of the second bipolar magnet such that it is located substantially between the first and second bipolar magnets. However, in its first angular position, the first highly magnetically permeable element is moved away from the aforementioned alignment axis.

It will be noted that actuation of the operating lever does not require a pivoted click associated with a return spring. It will also be noted that the magnetic system makes it possible to avoid any contact between the operating member and the switching member.

In an advantageous variant, the switching path of the first bipolar magnet substantially coincides with the axis of alignment defined by the magnetic axis of the second bipolar magnet, and this first bipolar magnet is arranged with its magnetic axis substantially oriented along this axis of alignment, the first and second bipolar magnets being arranged with opposite polarities.

BRIEF DESCRIPTION OF THE DRAWINGS

The invention will be described in detail below with reference to the annexed drawings, given by way of non-limiting example, and in which.

DETAILED DESCRIPTION OF THE INVENTION

Figure 1:
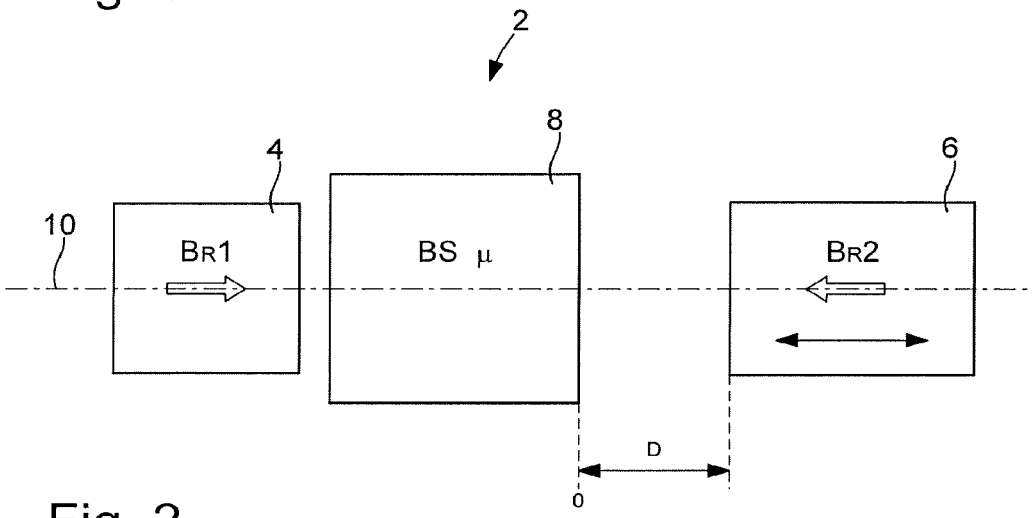
FIG. 1 schematically shows a magnetic system whose particular behaviour is put to good use in the present invention.
Figure 2:
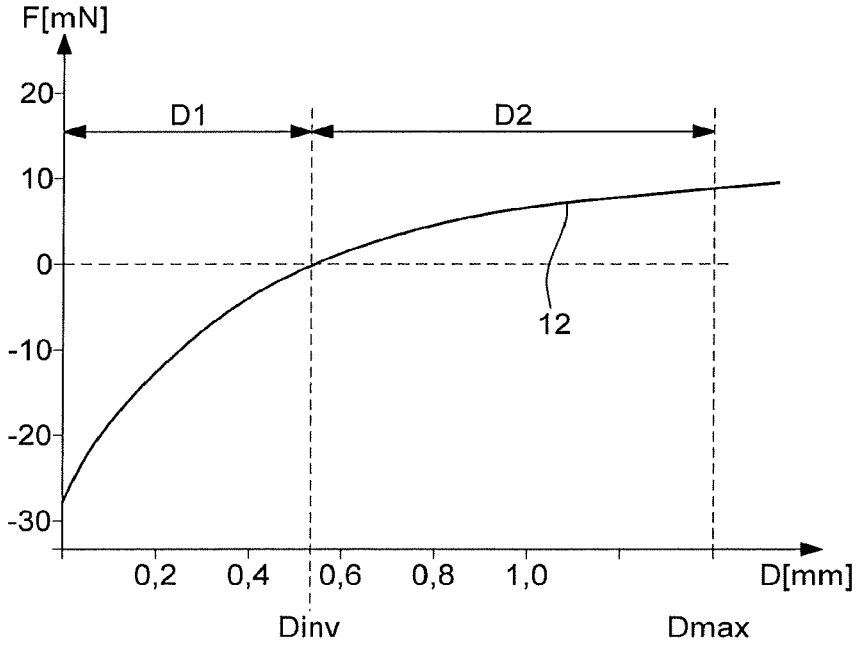
FIG. 2 represents a graph of the magnetic force experienced by a movable magnet of the magnetic system of FIG. 1 as a function of its distance away from a highly magnetically permeable element forming one part of this magnetic system.

We will start by describing, with reference to FIGS. 1 and 2, a magnetic system which the present invention ingeniously implements to achieve a bistable, preferably contactless, switching device between the operating member and the switching member, without requiring a return spring to move and then hold the switching member in one or other of its two stable positions.

Magnetic system 2 includes a first fixed magnet 4, a highly magnetically permeable element 6 and a second magnet 8 which is movable, along a displacement axis coincident here with the axis of alignment 10 of these three magnetic elements, relative to the assembly formed by first magnet 4 and element 6. Element 6 is arranged between the first magnet and the second magnet, close to the first magnet and in a determined position relative to the latter. In a particular variant, the distance between element 6 and magnet 4 is less than or substantially equal to one tenth of the length of this magnet along its axis of magnetization. Element 6 consists, for example, of a carbon steel, tungsten carbide, nickel, FeSi or FeNi, or other alloys with cobalt such as Vacozet® (CoFeNi) or Vacoflux (CoFe). In an advantageous variant, this highly magnetically permeable element consists of an iron or cobalt-based metallic glass. Element 6 is characterized by a saturation field $B_S$ and a permeability p. Magnets 4 and 8 are, for example, made of ferrite, of FeCo or PtCo, of rare earths such as NdFeB or SmCo. These magnets are characterized by their remnant field Br1 and Br2.

Highly magnetically permeable element 6 has a central axis which is preferably substantially coincident with the axis of magnetization of first magnet 4 and also with the axis of magnetization of second magnet 8, this central axis being coincident here with axis of alignment 10. The respective directions of magnetization of magnets 4 and 8 are opposite. These first and second magnets thus have opposite polarities and are capable of undergoing a relative motion between them over a certain relative distance. The distance D between element 6 and movable magnet 8 indicates the distance of separation between this movable magnet and the other two elements of the magnetic system. It will be noted that axis 10 is arranged here to be linear, but this is a non-limiting variant. Indeed, the axis of displacement may also be curved, as in the embodiments that will be described hereainafter. In this latter case, the central axis of element 6 is preferably approximately tangent to the curved axis of displacement and thus the behaviour of such a magnetic system is, at first glance, similar to that of the magnetic system described here. This is all the more so if the radius of curvature is large relative to the maximum possible distance between element 6 and movable magnet 8. In a preferred variant, as represented in FIG. 1, element 6 has dimensions in a plane orthogonal to central axis 10 which are greater than those of first magnet 4 and than those of second magnet 8 in projection into this orthogonal plane. It will be noted that, in the case where the second magnet is stopped against the highly magnetically permeable element at the end of travel, the second magnet advantageously has a hardened surface or a fine surface layer of hard material.

The two magnets 4 and 8 are arranged to repel each other so that, in the absence of highly magnetically permeable element 6, a repelling force tends to moves these two magnets away from each other. However, surprisingly, the arrangement between these two magnets of element 6 reverses the direction of the magnetic force exerted on the movable magnet when the distance between this movable magnet and element 6 is sufficiently small, so that the movable magnet is then subjected to a force of magnetic attraction. Curve 12 of FIG. 2 represents the magnetic force exerted on movable magnet 8 by magnetic system 2 as a function of the distance D between the movable magnet and the highly magnetically permeable element. It is noted that the movable magnet is subjected overall, over a first range D1 of distance D, to a force of magnetic attraction which tends to hold magnet 8 against element 6 or to return it towards element 6 if it is remote therefrom, this overall force of attraction resulting from the presence of the highly magnetically permeable (especially ferromagnetic) element between the two magnets, which allows a reversal of the magnetic force between two magnets arranged to repel each other magnetically, whereas this movable magnet is subjected overall, over a second range D2 of distance D to a force of magnetic repulsion. This second range corresponds to distances between element 6 and magnet 8 which are greater than the distances corresponding to the first range of distance D. The second range is limited in practice to a maximum distance $D_{max}$ which is generally defined by a stop limiting the separation distance of the movable magnet.

The magnetic force exerted on the movable magnet is a continuous function of distance D and it therefore has a zero value at distance $D_{inv}$ at which there is a reversal of this magnetic force (FIG. 2). This is a remarkable operation of magnetic system 2. The reversal distance $D_{inv}$, is determined by the geometry of the three magnetic components forming the magnetic system and by their magnetic properties. This reversal distance may thus be selected, to a certain extent, by the physical parameters of the three magnetic elements of magnetic system 2 and by the distance separating the fixed magnet from ferromagnetic element 6. The same applies to the evolution of the slope of curve 12, since the variation in this slope and, in particular, the intensity of the force of attraction when the movable magnet approaches the ferromagnetic element, can thus be adjusted.

Referring to FIGS. 3 to 7, an embodiment of the invention will be described below.

The timepiece movement 22 includes a chronograph mechanism 24 partially represented by chronograph wheel 26. In a conventional manner, this chronograph mechanism can switch between a first uncoupled state, i.e. stopped, and a second coupled state, in which chronograph wheel 26 is kinematically coupled to the drive wheel 28 of the timepiece movement. To this end, a switching device is provided for the chronograph mechanism, forming a coupling device 30 for the mechanism, and an device 32 for actuation of the coupling device. Coupling device 30 includes an operating member formed by an operating lever 34 actuated by the actuation device, and a switching member 36, which includes a coupling lever 38 mounted on a plate 23, a lever bar 40 and a coupling wheel 42 pivoted between this lever and bar. Switching member 36 is able to change on demand from a first stable position (FIG. 3), in which an arm of lever 38 is resting against stop 44 and the coupling wheel in a position of non-engagement with the chronograph wheel, to a second stable position (FIG. 4), in which the aforementioned arm of lever 38 is resting against stop 45 and the coupling wheel in a position of engagement with the chronograph wheel; and vice versa.

To this end, a first bipolar magnet 50 is fixed to a first end of lever 38 which is pivoted about an arbor 46 at its second end. When the switching member passes from its first stable position to its second stable position, magnet 50 undergoes a motion along a switching path defined by the arc of a circle travelled by this magnet between its first switching position and its second switching position, respectively corresponding to the first and second stable positions of the switching member. Magnet 50 follows the same path in the opposite direction when it passes from its second switching position to its first switching position.

Next, timepiece 22 includes a second bipolar magnet 52 which is fixed to plate 23 so as to continually offer a magnetic interaction with first bipolar magnet 50 between its first and second switching positions.

According to the invention, operating lever 34 includes a first highly magnetically permeable element 54 and is arranged so that, when it is repeatedly actuated by the actuation device, the first highly magnetically permeable element undergoes a reciprocating motion between a first operating position and a second operating position. The operating lever is pivoted so that first highly magnetically permeable element 54 undergoes a rotation between a first angular position (FIG. 3) and a second angular position (FIG. 4) respectively defining the first operating position and the second operating position. When first element 54 is in its second angular position, it is located substantially between the first and second bipolar magnets, so as to form with said two bipolar magnets a magnetic system of the type previously described in FIGS. 1 and 2.

Preferably, in its second angular position, first element 54 is located on an axis of alignment 56 defined by the magnetic axis of magnet 52 so that it is located substantially between the first and second bipolar magnets; whereas, in its first angular position, first element 54 is remote from axis of alignment 56. Preferably, as is the case in the embodiment described, the switching path of bipolar magnet 50 is substantially coincident with axis of alignment 56, so that the two bipolar magnets are substantially aligned on this axis of alignment in any position of magnet 50 along the switching path. Next, magnet 50 is arranged with its magnetic axis substantially oriented along the axis of alignment and such that the first and second bipolar magnets 50 and 52 have opposite polarities.

Figure 4:
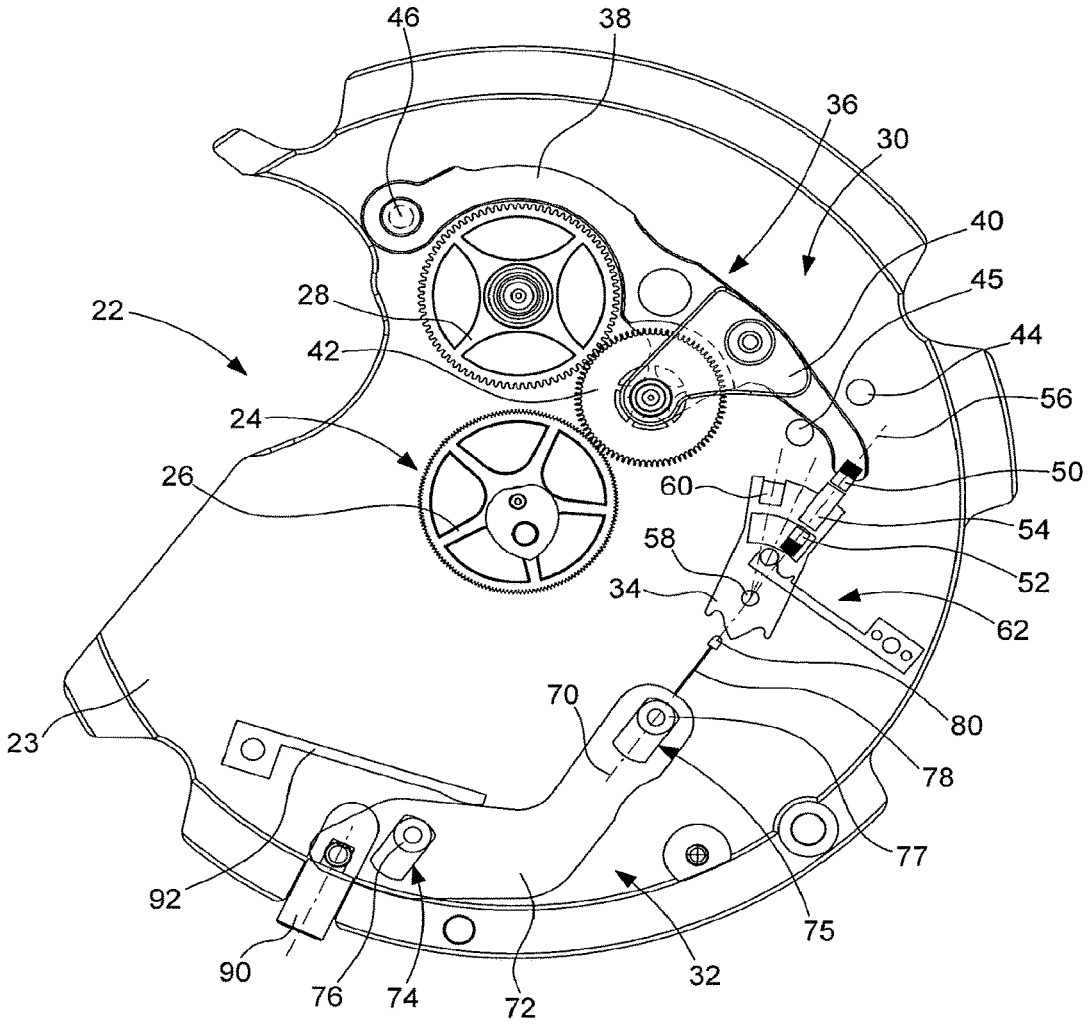

In the advantageous variant described with reference to the Figures, in particular FIGS. 4 and 5D, it will be noted that, when, on the one hand, operating lever 34 is in its second operating position and first element 54 is thus facing second magnet 52, and, on the other hand, switching member 36 is in its second stable position in which first magnet 50 is subjected to a force of magnetic attraction, this first magnet, second magnet 52 and highly magnetically permeable element 54 are all aligned on axis of alignment 56, i.e. the respective magnetic axes of these two magnets and the longitudinal axis of element 54 are parallel and located on the same line. The fact that the axis of alignment intercepts axis of rotation 58 represents an advantageous, but in no way necessary, case.

Figure 3:
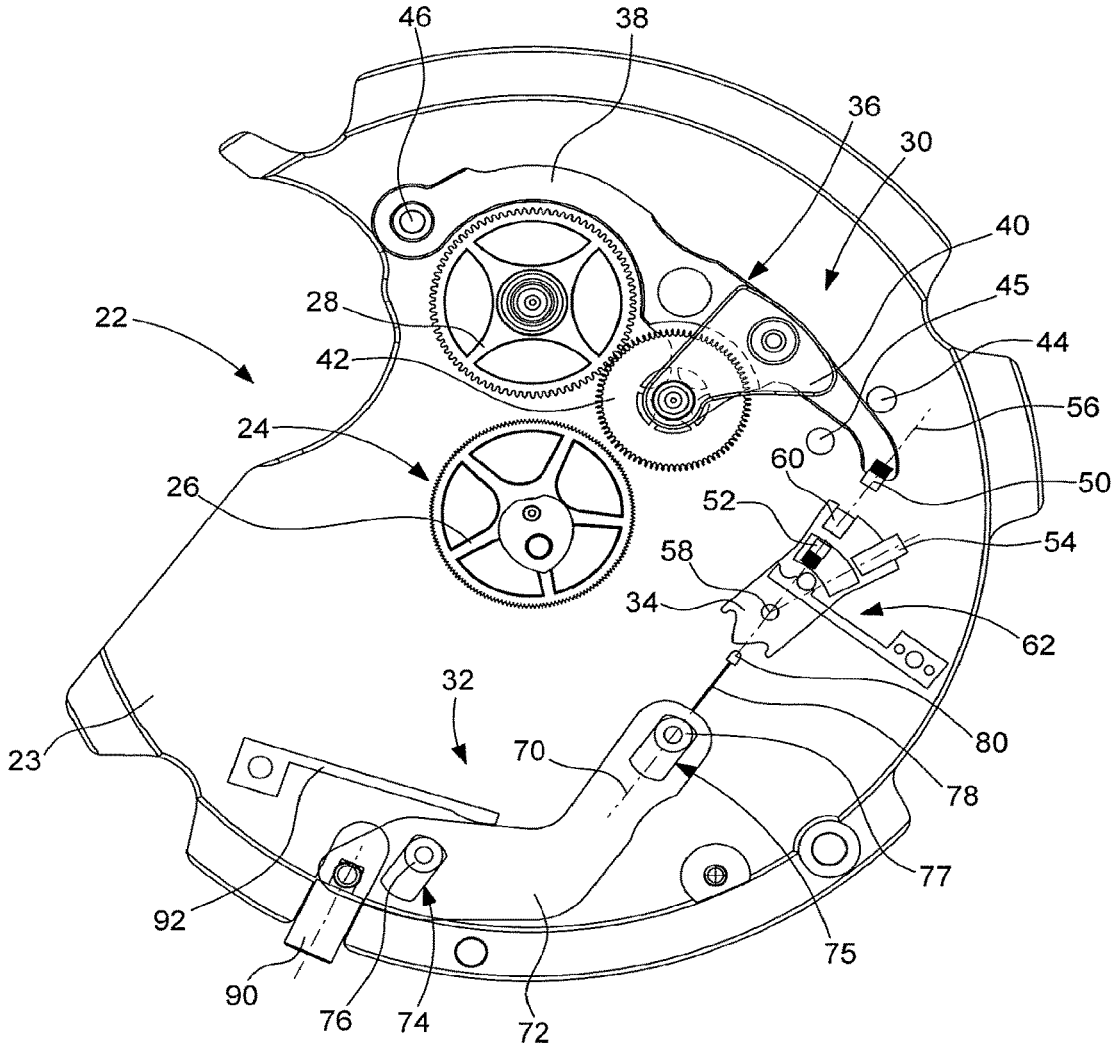
FIGS. 3 and 4 are plan views of an embodiment of the invention wherein a chronograph mechanism is switched by a coupling device between a coupled state and an uncoupled state.

Operating lever 34 further includes a second highly magnetically permeable element 60 arranged to be substantially aligned with the first and second bipolar magnets 50 and 52 when first highly magnetically permeable element 54 is in its first operating position (FIG. 3). It will immediately be noted that this second element 60 is not indispensable to the invention. Thus, in a particular variant, the operating lever has only one highly magnetically permeable element, namely element 54. However, second element 60 is advantageous, since it serves in particular to partially channel the flux from second magnet 52 along axis of alignment 56 when the operating lever is in its first operating position and thereby promote its interaction with first magnet 50, without element 54 deflecting to any great extent the magnetic flux from the magnets in its transverse direction relative to the axis of alignment. Further, this element 60 serves to adjust the force of magnetic repulsion and particularly to limit this force. In an advantageous variant, the second highly magnetically permeable element is arranged to be located closer to one or other of the first and second bipolar magnets whatever the position of the first bipolar magnet along the switching path, so as to have a force of magnetic repulsion over the entire switching path.

The operating lever includes a positioning device 62 formed by a pin 66 associated with a positioning spring 64. This spring has two positioning hollows which respectively define the first and second angular positions of the lever when the pin is housed successively in these two hollows. The operating lever further includes an opening 68, between its axis of rotation 58 and first highly magnetically permeable element 54, in which is arranged second magnet 52, this opening having a contour arranged such that the operating lever can freely undergo rotation between its first and second angular positions. In the variant represented, opening 68 takes the form of an annular sector and elements 54 and 60 are located facing this opening relative to the rotational axis, on either side of an axis of symmetry of the annular opening.

Actuation device 32 includes a shuttle 72 guided in translation in a direction of translation. To this end, the shuttle includes two oblong holes 74 and 75 in which are respectively arranged two rollers 76 and 77 mounted to rotate on two arbors fixed to plate 23. To alternately actuate lever 34 in the two directions of rotation between its two stable angular positions, the shuttle includes, at one end oriented towards a rear part of the lever, a strip-spring 78 ending in an actuation head 80 and extending, in its non-deformed position (rest position), along a thrust axis 70 parallel to the direction of translation and advantageously intercepting rotational axis 58 of the operating lever. Next, the rear part of the lever is located on a side opposite to first element 54 relative to rotational axis 58, this rear part having a symmetrical profile with two actuation hollows 85 and 86 respectively located on either side of an axis of symmetry 88 intercepting rotational axis 58, and whose respective profiles are arranged to receive actuation head 80. The rear part of the lever also has a protruding portion 82 which is arranged between the two actuation hollows and which has two symmetrical flanks 83 and 84 respectively ending in the two actuation hollows. Axis of symmetry 88 of the aforementioned rear part passes substantially through the tip of protruding portion 82.

Figure 5A:
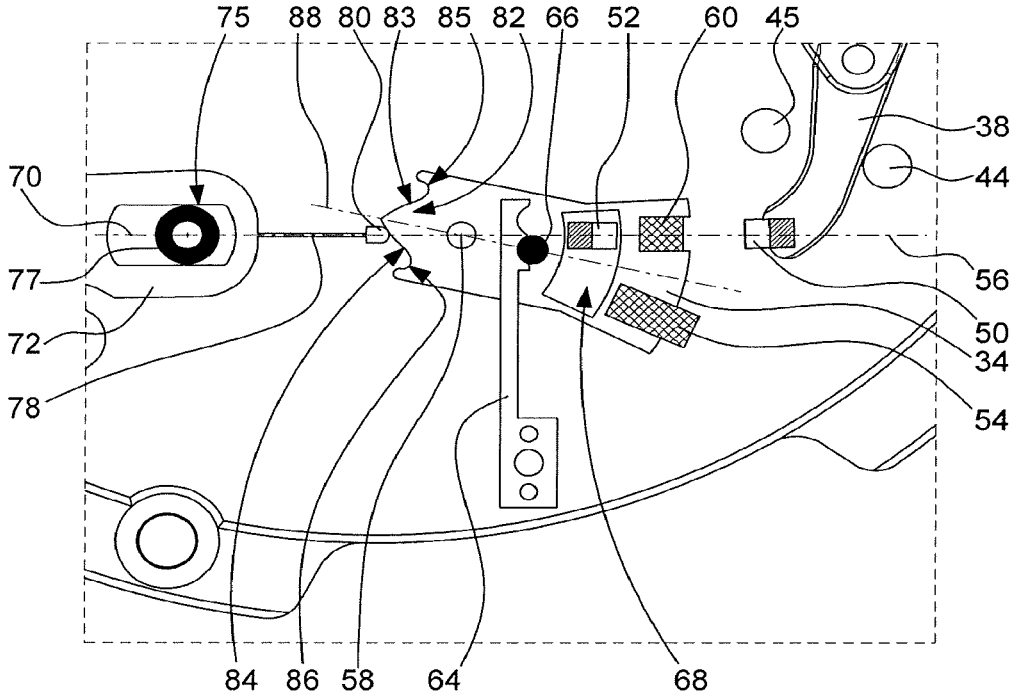
FIGS. 5A to 5D represent various successive phases of the actuation of an operating lever between its two angular operating positions.
Figure 5B:
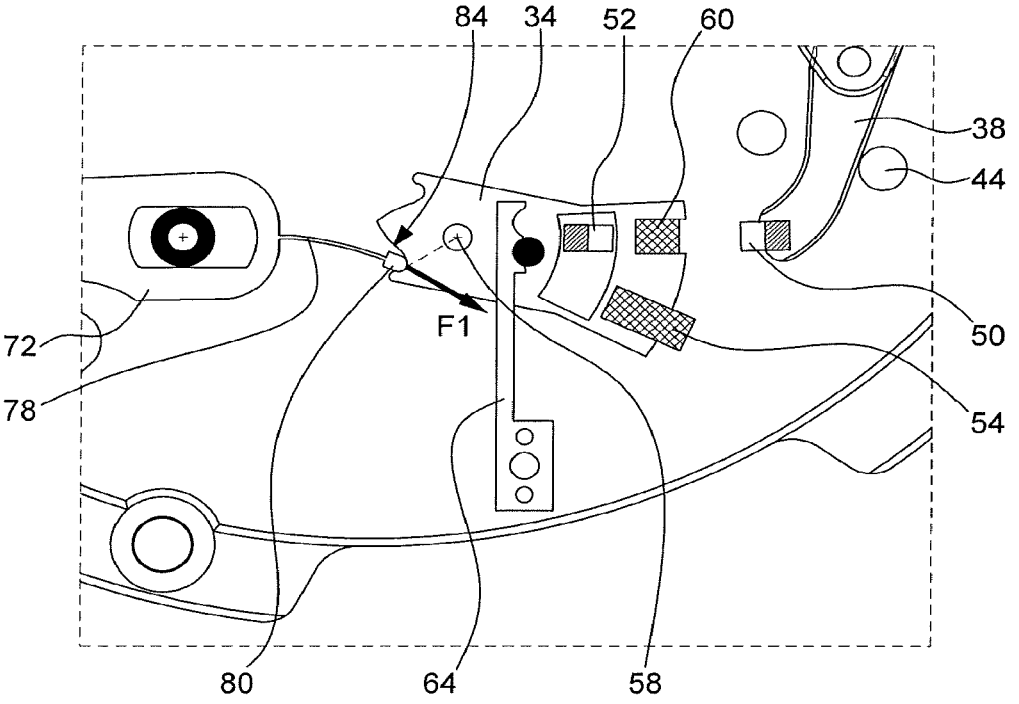
Figure 5C:
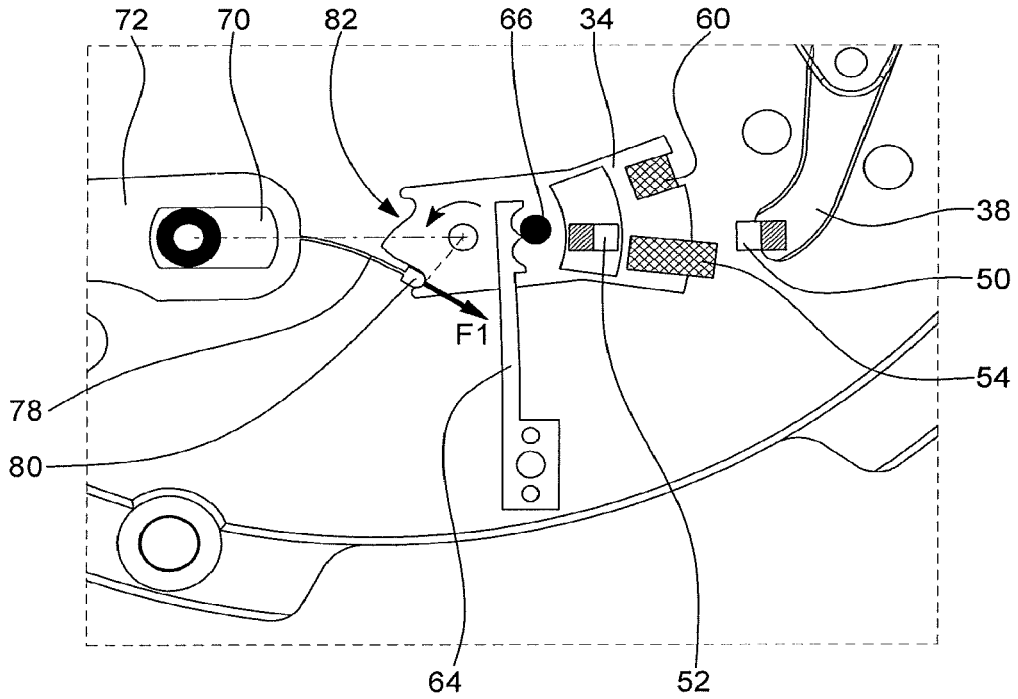
Figure 5D:
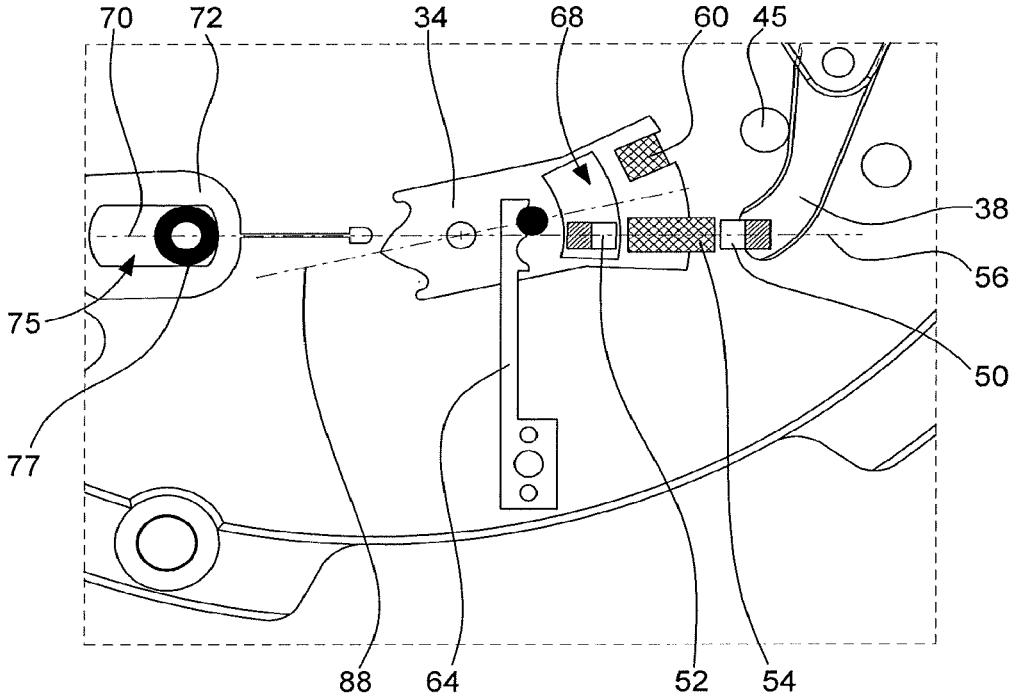

Remarkably, as represented in FIGS. 5A to 5D, shuttle 72 and operating lever 34 are arranged such that, when lever 34 is in either of its two operating positions and the shuttle is pushed towards the lever by means of a pusher 90, actuation head 80 first abuts against one (flank 84 in FIG. 5A) of the two flanks of the protruding portion facing said head (see FIG. 5A) and then slides along this flank, elastically deforming strip-spring 78, until it is housed inside the actuation hollow at the bottom of the hollow in question (see FIG. 5B). Then, continuing to push the shuttle along its direction of translation, the actuation head generates a thrust force F1 which produces a moment of force on the lever driving it in rotation at least past a median angular position between said first and second angular positions (see FIG. 5C), so as to enable the operating lever to tip into the other of its two operating positions (see FIG. 5D). By repeating this lever actuation operation, the operating lever actuation device can tip the operating lever alternately between its first and second stable angular positions corresponding to the two operating positions of the operating lever.

It will be noted that there is provided a spring 92 which exerts a return force on shuttle 72. This spring may be replaced by a spring incorporated in a push-button associated with pusher 90 if this latter rotates integrally with the push-button. As will be seen below, the switching device of the invention requires a low thrust force on the pusher so that it is essentially possible to determine the force that a user has to apply to change the state of the chronograph mechanism by selecting the return force of the spring associated with the shuttle.

The following few observations relate to the preferred embodiment represented in the Figures:

the fact that pin 66 is located on axis of symmetry 88 forms only one advantageous symmetrical variant for positioning device 62;

the fact that strip-spring 78 is arranged at rest (in its non-deformed state) on thrust axis 70 of the shuttle represents an advantageous but not essential variant (indeed it is possible to envisage a certain angle between them);

the fact that the thrust axis, on which the strip-spring is located at rest, intercepts rotational axis 58 and that axis of symmetry 88 has an identical angular offset (in absolute value) with this thrust axis in both operating positions of the lever constitutes a preferred variant;

the fact that axis of alignment 56 is parallel to the direction of translation of the shuttle is a particular, but not essential case:

and the fact that thrust axis 70 is coincident with axis of alignment 56 defines an advantageous but not essential case.

Figure 6A:
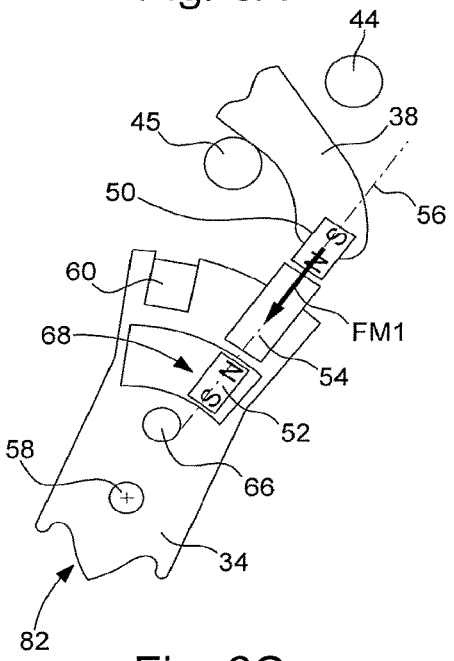
FIGS. 6A to 6D schematically represent the magnetic system of the invention in four particular situations with the respective magnetic forces that are exerted on a magnet carried by a coupling lever.
Figure 6B:
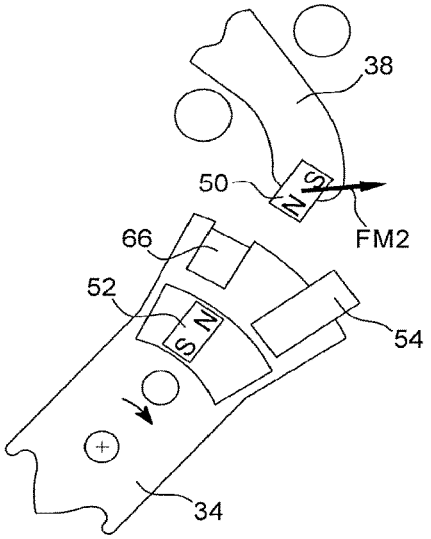
Figure 6C:
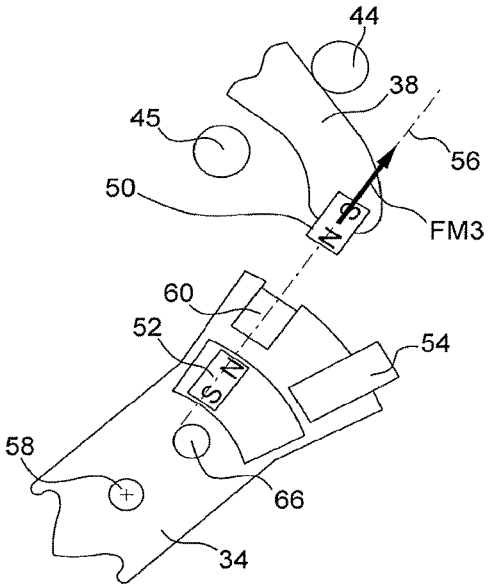
Figure 6D:
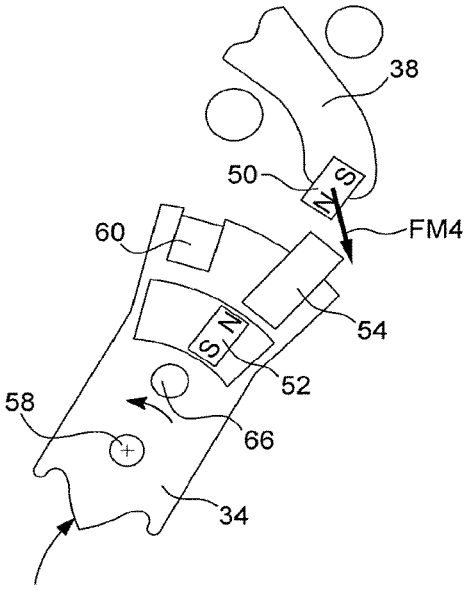
Figure 7:
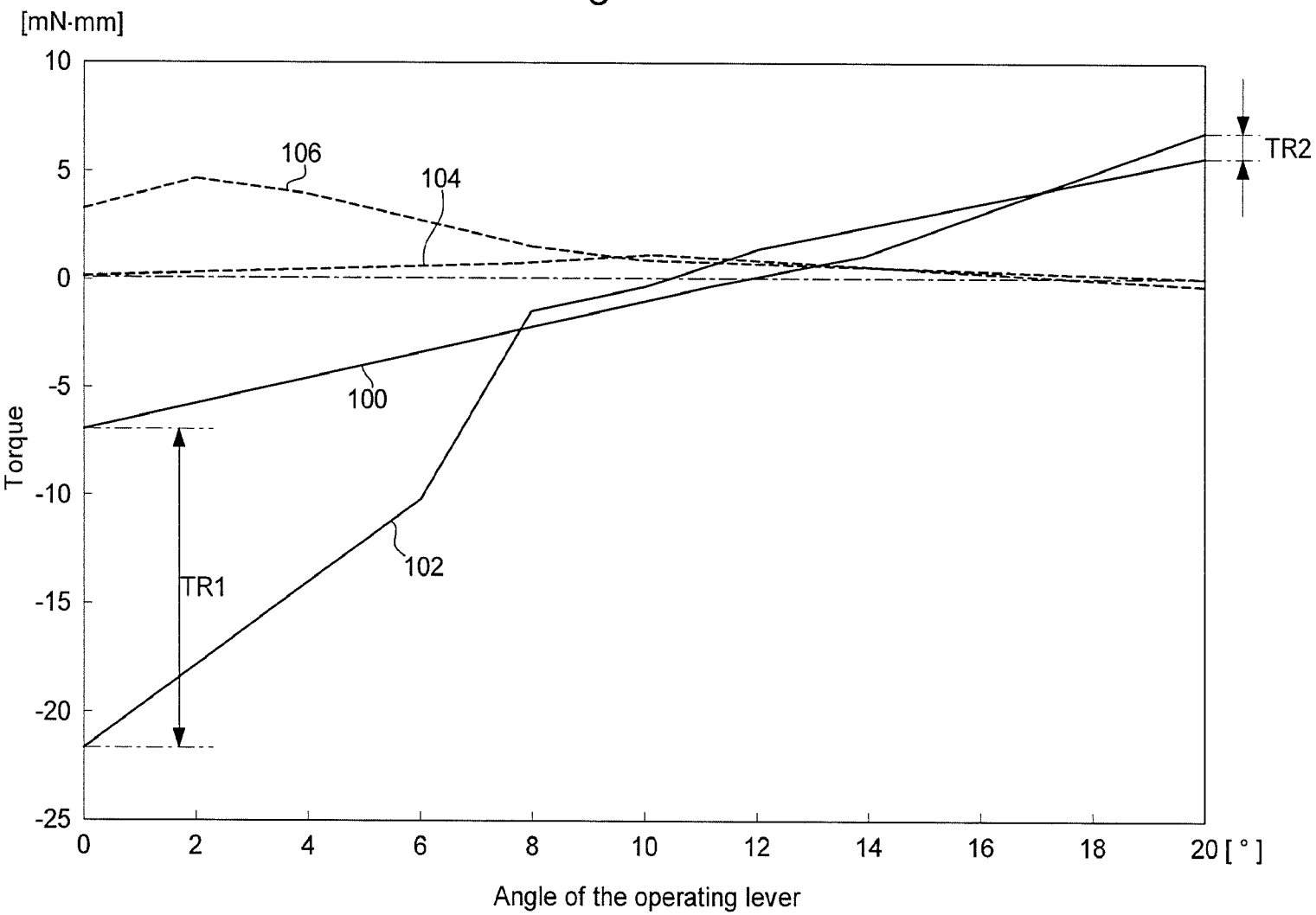
FIG. 7 shows four torque curves as a function of the angular position of the operating lever, these curves showing the torques to which the torque lever and coupling lever are respectively subjected when the latter is either in its coupled position, or in its uncoupled position.

Referring more particularly to FIGS. 6A to 6D and 7 and in light of the operation of the magnetic system described above with reference to FIGS. 1 and 2, there will be described hereinafter the operation of coupling device 30. FIG. 7 represents four torque curves as a function of the angular position of operating lever 34, respectively of the angular position of the first highly magnetically permeable element 54 between the two stable positions of the operating lever, respectively between the two operating positions of element 54. For the embodiment described with reference to the Figures, the 0° position corresponds to the second operating position of element 54 whereas the 20° position corresponds to the first operating position of element 54. In the 0° angular position of the lever, the coupling device is coupled or brought into the coupled position. In the 20° angular position of the lever, the coupling device is uncoupled or brought into the uncoupled position. These four curves represent the torques exerted, on the one hand, on chronograph lever 38 and thus on switching member 36 (curves 100 and 102) and, on the other hand, on the operating lever (curves 104 and 106) when the switching member is held (forcibly) either in its first stable position (curves 100 and 104), or in its second stable position (curves 102 and 106).

Regardless of the position of the switching member, it is seen that the torque produced by the magnetic force generated by the magnetic system, composed of two magnets 50 and 52 and two highly magnetically permeable elements 54 and 60, changes from a negative torque corresponding to a force of magnetic attraction when the operating lever occupies the 0° angular position to a positive torque corresponding to a force of magnetic repulsion when the lever occupies the 20° angular position. Thus, for the 0° angular position of the operating lever, the torque range TR1 exerted on the coupling member is entirely negative, whereas for the 20° angular position of the lever, the torque range TR2 exerted on the coupling member is entirely positive. In conclusion, as revealed by the torque curves of FIG. 7, the coupling device is arranged such that, when first element 54 is in its second operating position (FIG. 4 and FIG. 6A), the first and second magnets 50 and 52 generate between them a force of magnetic attraction (attracting magnetic force) on the entire switching path of the first magnet, and such that, when first element 54 is in its first operating position (FIG. 3 and FIG. 6C), the first and second magnets generate between them a force of magnetic repulsion (repelling magnetic force) over the entire switching path.

Further, the force of magnetic repulsion is provided with an intensity and a range that are sufficient for the force of magnetic repulsion alone to actuate switching member 36 between its first stable position and its second stable position, and then hold said member in this second stable position; whereas the magnetic attraction force has an intensity and a range that are sufficient for the magnetic attraction force alone to actuate the switching member between its second stable position and its first stable position and then hold said member in this first stable position. Thus, there is no requirement for a return spring associated with the switching member in this preferred embodiment.

FIG. 7 shows another advantage of the switching device according to the invention. It is observed that the torque that has to be exerted on the operating lever is much lower than the torque that is exerted on the switching member (coupling lever 38). Thus, a user has to apply less force on the pusher to start the coupling function, respectively the uncoupling function, compared to a conventional mechanical device.

It will be noted that, in another variant, the uncoupled state and the coupled state are reversed so that the chronograph mechanism is driven when the operating member is in one of its two operating positions generating a force of magnetic repulsion, whereas it is stopped when the operating member is in the other of its two operating positions generating a force of magnetic attraction.

FIGS. 6A to 6D are provided to shown the variation in the magnetic force that occurs on magnet 50 integral with coupling lever 38 as a function of the angular position of operating lever 34. FIG. 6A partially shows coupling device 30 in its coupled state with the operating lever in its stable coupling position. The magnetic force FM1 is a force of magnetic attraction in the direction of fixed magnet 52, this force being oriented substantially along axis of alignment 56, and has a relatively high intensity because movable magnet 50 is located opposite the highly magnetically permeable element 54 (the longer of the two elements 54 and 60) and at a short distance therefrom, this element 54 also being at a short distance from fixed magnet 52. FIG. 6B shows the coupling device passing to an uncoupled state by the operating lever tipping in the clockwise direction. Magnetic force FM2 changes orientation when lever 34 is pivoted during this change and it becomes a force of magnetic repulsion for movable magnet 50, respectively for coupling lever 38 carrying the magnet. FIG. 6C shows the operating lever in its stable uncoupling position with the highly magnetically permeable element 60 (the shorter of the two elements 54 and 60) substantially aligned on axis of alignment 56. The distance between element 60 and movable magnet 50 is relatively large and the force of magnetic repulsion FM3 is substantially oriented along the axis of alignment. Finally, FIG. 6D shows the coupling device passing from a coupled state to an uncoupled state when lever 34 tips in the anticlockwise direction. Magnetic force FM4 changes orientation again during this change to become a force of magnetic attraction as movable magnet 50 approaches element 54. When the operating lever has finished pivoting, we return to the configuration of FIG. 6A again. Thus, one complete cycle of the coupling device according to the invention has finished.

What is claimed is:

1. A timepiece comprising a mechanism able to switch between a first state and a second state, a switching device for switching said mechanism between its the first state and the second state and an actuation device for actuation of said switching device; the switching device comprising an operating member actuated by said actuation device and a switching member, said switching member being arranged such that the switching member is capable of changing on demand from a first stable position, wherein the mechanism is in the first state, to a second stable position, wherein the mechanism is in the second state, and vice versa;

said timepiece comprising:

a first bipolar magnet which is fixed to said switching member so as to undergo, when said switching member changes from the first stable position to the second stable position, a motion along a switching path between a first switching position and a second switching position, and vice versa, a second bipolar magnet which is fixed to a support of the coupling device so as to continually offer a magnetic interaction with the first bipolar magnet between the first and second switching positions thereof, and at least a first highly magnetically permeable element at least partially forming said operating member;

wherein said operating member is arranged so that, when said operating member is repeatedly actuated by the actuation device, the first highly magnetically permeable element is subjected to a back-and-forth motion between a first operating position and a second operating position; and wherein the switching device is arranged so that, when the first highly magnetically permeable element is in the first operating position thereof, the first and second magnets generate therebetween a force of magnetic repulsion over substantially the entire said switching path and so that, when the first highly magnetically permeable element is in the second operating position thereof, the first and second magnets generate therebetween a force of magnetic attraction on at least one part of the switching path, said part being located on the side of the second bipolar magnet.

2. The timepiece according to claim 1, wherein the force of magnetic repulsion has an intensity and a range that are sufficient for the force of magnetic repulsion alone to actuate the switching member between the first stable position and the second stable position thereof and then to hold said switching member in said second stable position, whereas the force of magnetic attraction has an intensity and a range that are sufficient for said force of magnetic attraction alone to actuate the switching member between the second stable position and the first stable position thereof and then to hold said switching member in said first stable position.

3. The timepiece according to claim 1, wherein said operating member is formed by an operating lever which is pivoted so that said first highly magnetically permeable element undergoes a rotation between a first angular position and a second angular position respectively defining the first operating position and the second operating position; wherein, when the first highly magnetically permeable element is in the second angular position, said first element is substantially located on an axis of alignment, defined by the magnetic axis of the second bipolar magnet, so that it is substantially between the first and second bipolar magnets: whereas, in the first angular position thereof, the first highly magnetically permeable element is remote from said axis of alignment.

4. The timepiece according to claim 3, wherein the switching path of the first bipolar magnet is substantially coincident with said axis of alignment and said first bipolar magnet is arranged with its magnetic axis substantially oriented along said axis of alignment, the first and second bipolar magnets being arranged with opposite polarities.

5. The timepiece according to claim 3, wherein the operating lever comprises an opening between the pivoting axis thereof and the first highly magnetically permeable element, said second magnet being arranged in said opening at least when the operating lever is in the second angular position thereof, said opening having a contour arranged so that the operating lever can freely undergo rotation between the first and second angular positions thereof.

6. The timepiece according to claim 3, wherein the operating lever comprises a pin associated with a positioning spring which has two positioning hollows respectively defining the first and second angular positions of the lever when the pin is housed in succession in said two positioning hollows.

7. The timepiece according to claim 3, wherein said actuation device comprises a shuttle guided in translation in a given direction of translation, said shuttle comprising, at one end oriented towards a rear part of the lever, a strip-spring ending in an actuation head and extending, in the non-deformed position thereof, along a thrust axis which is parallel to said direction of translation and substantially intercepting the pivoting axis of the operating lever; wherein said rear part of the lever is located on a side opposite to said first highly magnetically permeable element relative to said pivoting axis, said rear part having a symmetrical profile with two actuation hollows respectively located on either side of an axis of symmetry substantially intercepting said pivoting axis, and whose respective profiles are arranged to receive the actuation head, a protruding portion being arranged between the two actuation hollows and having two symmetrical flanks respectively ending in the two actuation hollows, said axis of symmetry of the rear part passing substantially through the tip of the protruding portion; and wherein the shuttle and the operating lever are arranged so that, when the shuttle is pushed in the direction of the operating lever, the actuation head slides first along one of the two flanks of the protruding portion facing said head, elastically deforming said strip-spring, until said head lodges inside the actuation hollow at the bottom of said flank, and then said actuation head generates a moment of force on the lever allowing it to be driven in rotation at least past a median angular position between said first and second angular positions, so as to allow the operating lever to tip alternately between the first and second angular positions thereof.

8. The timepiece according to claim 3, wherein said operating member further comprises a second highly magnetically permeable element arranged to be substantially aligned with said first and second bipolar magnets when the first highly magnetically permeable element is in the first operating position thereof.

9. The timepiece according to claim 3, wherein said switching member includes a coupling lever to which the first magnet is fixed, the first and second stable positions of the coupling lever being defined respectively by two stops between which an arm of said coupling lever passes.

10. The timepiece according to claim 1, wherein said operating member further comprises a second highly magnetically permeable element arranged to be substantially aligned with said first and second bipolar magnets when the first highly magnetically permeable element is in the first operating position thereof.

11. The timepiece according to claim 10, wherein the second highly magnetically permeable element is arranged to be located closer to one or other of the first and second bipolar magnets regardless of the position of the first bipolar magnet along said switching path.

12. The timepiece according to claim 1, wherein said switching member is a coupling member including a coupling lever to which the first magnet is fixed, the first and second stable positions of the coupling lever being defined respectively by two stops between which an arm of said coupling lever passes.

13. The timepiece according to claim 12, wherein said mechanism is a chronograph mechanism, the actuation device comprising a pusher able to be actuated by a timepiece user.

* * * * *